US008858044B2

(12) United States Patent
Tang et al.

(10) Patent No.: US 8,858,044 B2
(45) Date of Patent: Oct. 14, 2014

(54) FOLDABLE LED TABLE LAMP

(75) Inventors: Chiang-Kuo Tang, New Taipei (TW); Dao-Cai Zheng, Shenzhen (CN); Xiao-Ling Yang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 134 days.

(21) Appl. No.: 13/494,036

(22) Filed: Jun. 12, 2012

(65) Prior Publication Data

US 2013/0170195 A1 Jul. 4, 2013

(30) Foreign Application Priority Data

Dec. 28, 2011 (CN) ..... 2011 2 0558165 U

(51) Int. Cl.

| | |
|---|---|
| ***F21S 6/00*** | (2006.01) |
| ***F21V 9/16*** | (2006.01) |
| ***F21V 19/02*** | (2006.01) |
| ***F21S 13/12*** | (2006.01) |
| ***F21V 21/40*** | (2006.01) |
| ***F21V 21/26*** | (2006.01) |
| ***F21K 99/00*** | (2010.01) |
| *F21V 23/04* | (2006.01) |
| *F21V 17/00* | (2006.01) |
| *F21Y 103/00* | (2006.01) |
| *F21Y 101/02* | (2006.01) |

(52) U.S. Cl.

CPC ..... *F21S 6/003* (2013.01); *F21V 23/0485* (2013.01); *F21V 21/26* (2013.01); *F21V 17/007* (2013.01); *F21Y 2103/003* (2013.01); *F21V 21/40* (2013.01); *F21K 9/56* (2013.01); *F21Y 2101/02* (2013.01)

USPC ..... 362/413; 362/84; 362/220; 362/228; 362/399; 362/414; 362/418; 362/427

(58) Field of Classification Search

CPC ..... F21V 21/10; F21V 21/108; F21V 21/26; F21V 21/30; F21V 23/0485; F21V 21/40; F21V 9/16; F21V 9/00; F21V 17/007; F21S 6/003; F21S 6/002; F21S 4/008; F21S 8/04; F21S 8/043; F21Y 2103/003; F21Y 2101/02; F21K 9/56

USPC ..... 362/220, 249.03, 370, 371, 395, 413, 362/414, 418, 419, 427, 84, 399, 400, 362/410–412, 228

See application file for complete search history.

(56) References Cited

U.S. PATENT DOCUMENTS 4,546,417 A * 10/1985 Watts ..... 362/84
6,896,230 B2 * 5/2005 Cvek ..... 248/276.1

(Continued)

*Primary Examiner* — Alan Cariaso
(74) *Attorney, Agent, or Firm* — Novak Druce Connolly Bove + Quigg LLP

(57) ABSTRACT

A foldable LED table lamp is provided. The foldable LED table lamp includes a base, an elongated holder, an elongated lamp body, an LED emitting element fixed in the lamp body, and a touch sensitive switch. The elongated holder has a first end hinged to the base and an opposing second. The elongated lamp body has a first end hinged to the second end of the holder. The lamp body is rotatable between a first position where the lamp body is substantially perpendicular to the holder and a second position where the lamp body is juxtaposed with and parallel with the holder. The touch sensitive switch is mounted on the base and is configured to control the LED emitting element.

11 Claims, 6 Drawing Sheets

(56) References Cited

U.S. PATENT DOCUMENTS

| | | | | |
|---|---|---|---|---|
| 7,396,140 | B2 * | 7/2008 | Cai | 362/167 |
| 7,445,357 | B2 * | 11/2008 | Behar et al. | 362/294 |
| 7,798,682 | B1 * | 9/2010 | Cvek | 362/410 |
| 7,896,568 | B2 * | 3/2011 | Atkinson | 403/62 |
| 8,177,399 | B2 * | 5/2012 | Tragatschnig | 362/401 |
| 8,287,162 | B2 * | 10/2012 | Lu et al. | 362/427 |
| 8,353,609 | B2 * | 1/2013 | Chou et al. | 362/450 |
| 8,408,761 | B2 * | 4/2013 | Ng et al. | 362/427 |
| 2007/0097689 | A1 * | 5/2007 | Barausky et al. | 362/287 |
| 2008/0291673 | A1 * | 11/2008 | Chen et al. | 362/231 |
| 2010/0271817 | A1 * | 10/2010 | Chung et al. | 362/234 |

* cited by examiner

FOLDABLE LED TABLE LAMP

BACKGROUND

1. Technical Field

The present: disclosure relates to foldable LED table lamps, and particularly, to a foldable LED table lamp with a holder and a body both of which are rotatable and foldable.

2. Description of Related Art

Due to the higher luminous efficiency and smaller volume, the light emitting diode (LED) emitting elements are applied in the lightings such as table lamps. Typically, an LED table lamp includes a base, a shield, an LED lamp equipped in the shield, a holder connecting the base with the shield and supporting the shield, and a rotary button. The holder is adapted to adjust the pose of the LED lamp and the shield conveniently for adjusting the lighting angle and the lighting area of the LED table lamp. The user also can adjust the brightness of the LED lamp and power on/off the LED lamp by turning the rotary button.

However, the LED table lamp is bulky because of the shape of the shield, the holder, and the base, which is inconvenience for carrying and storing. Furthermore, to turn the rotary button, usually more than one finger is needed, which is also inconvenience.

Therefore, what is needed is a foldable LED table lamp with a holder and a body both of which are rotatable and foldable to overcome the limitations described above.

BRIEF DESCRIPTION OF THE DRAWINGS

The components in the drawings are not necessarily drawn to scale, the emphasis instead being placed upon clearly illustrating the principles of a foldable LED table lamp with a holder and a body both of which being rotatable and foldable. Moreover, in the drawings, like reference numerals designate corresponding parts throughout the several views.

DETAILED DESCRIPTION

Figure 1:
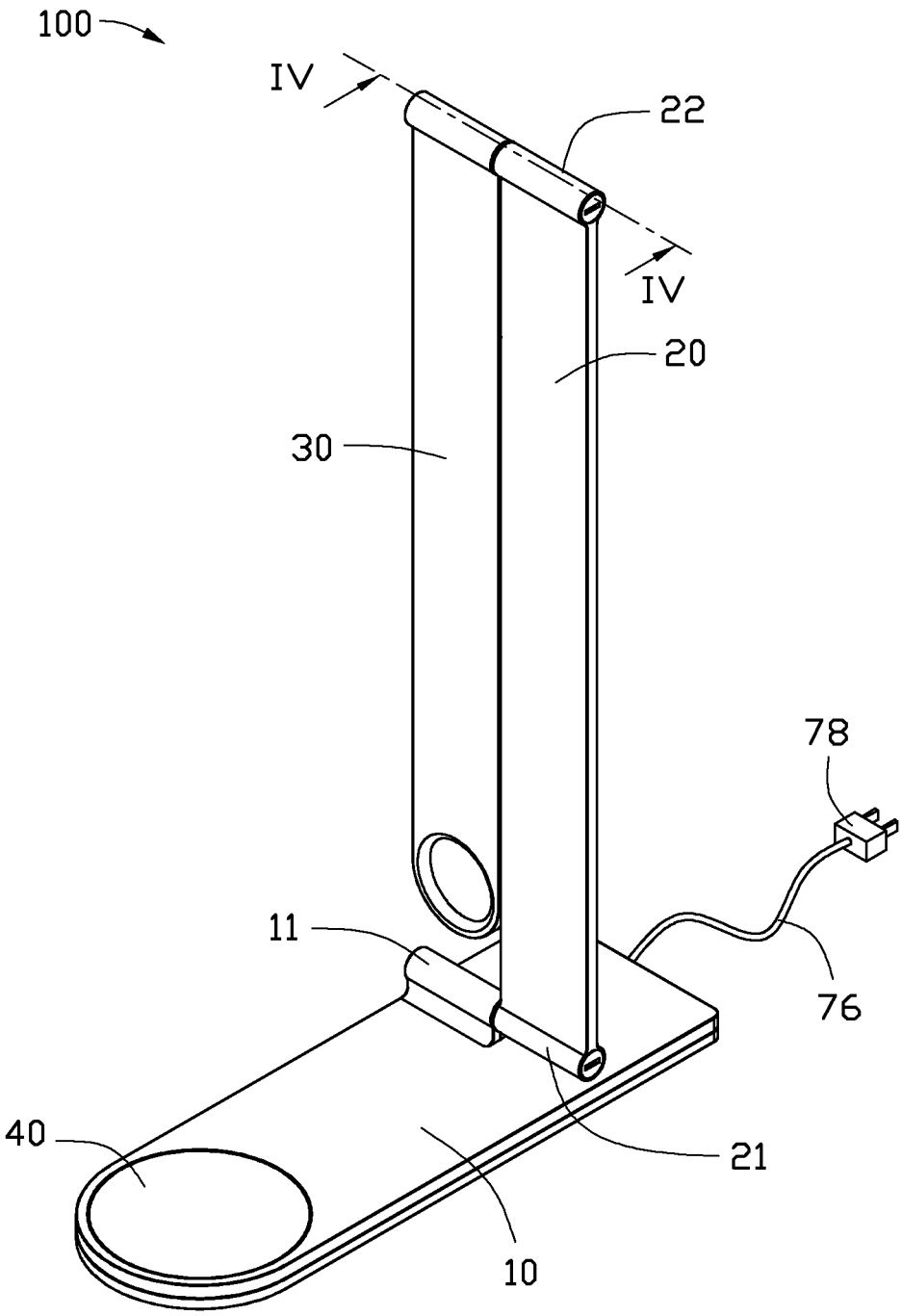
FIG. 1 is an isometric view of an exemplary embodiment of a foldable LED table lamp.

Referring to FIG. 1, a foldable LED table lamp 100 is shown as an exemplary embodiment. The table lamp 100 includes a base 10 with a connection element 11, a holder 20, a lamp body 30 being located paratactic with the holder 20, and a touch sensitive switch 40, in the embodiment, the body of the base 10, the holder 20 and the lamp body 30 are thin, flat and strip-shaped.

One end of the holder 20 has a first connection portion 21 for rotatably connecting the holder 20 to the base 10, and the other, opposite end of the holder 20 has a second connection portion 22 for rotatably connecting the holder 20 to the lamp body 30. The lamp body 30 has a third connection portion 31 at one end for connecting the lamp body 30 to the holder 20.

The other, opposite end of the lamp body 30 has a handle 32. In the embodiment, the handle 32 is annular. The switch 40 is a circular capacitive touch sensitive switch, and is used to turn on/off the table lamp 100, and to adjust the brightness and/or the color temperature of the table lamp 100.

Figure 2:
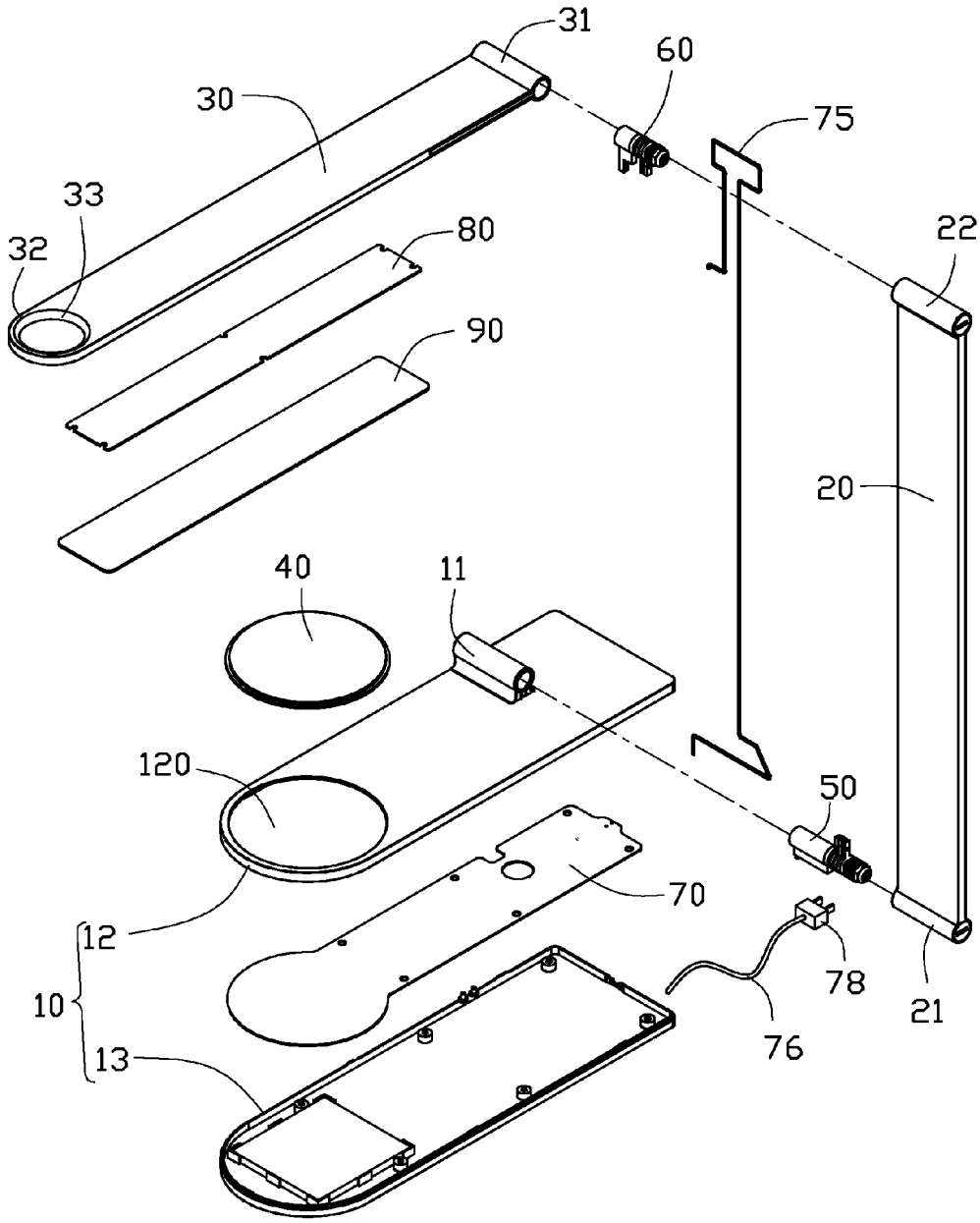
FIG. 2 is an exploded view of the foldable LED table lamp of FIG. 1.

Referring to FIG. 2, the table lamp 100 further includes a first hinge 50, a second hinge 60, a first printed circuit board (PCB) 70 secured in the base 10. The first hinge 50 and the second hinge 60 are parallel to each other. One end of the hinge 50 is fixed in the connection element 11, and the other end of the hinge 50 is received in the first connection portion 21, thus rotatably connecting the holder to the base 10. One end of second hinge 60 is fixed in the second connection portion 22, and the other end of the second hinge 60 is received in the third connection portion 31, thus to rotatably connecting the lamp body 30 to the holder 30.

The base 10 includes an upper cover 12 defining an opening 120, and a bottom cover 13 coupled to the upper cover 12. The first PCB board 70 is fixed to the bottom cover 13. In the embodiment, the touch switch 40 is affixed to the first PCB board 70 via a double-faced adhesive tape (not shown). The touch switch 40 is electrically connected with the first PCB board 70. The touch switch 40 is fit within the opening 120, and the upper surface of the touch switch 40 is flush with the upper surface of the base 10. In an alternative embodiment, the upper surface of the touch switch 40 may be slightly higher than the upper surface of the base 10, thus providing a better operation feeling to the user.

Figure 3:
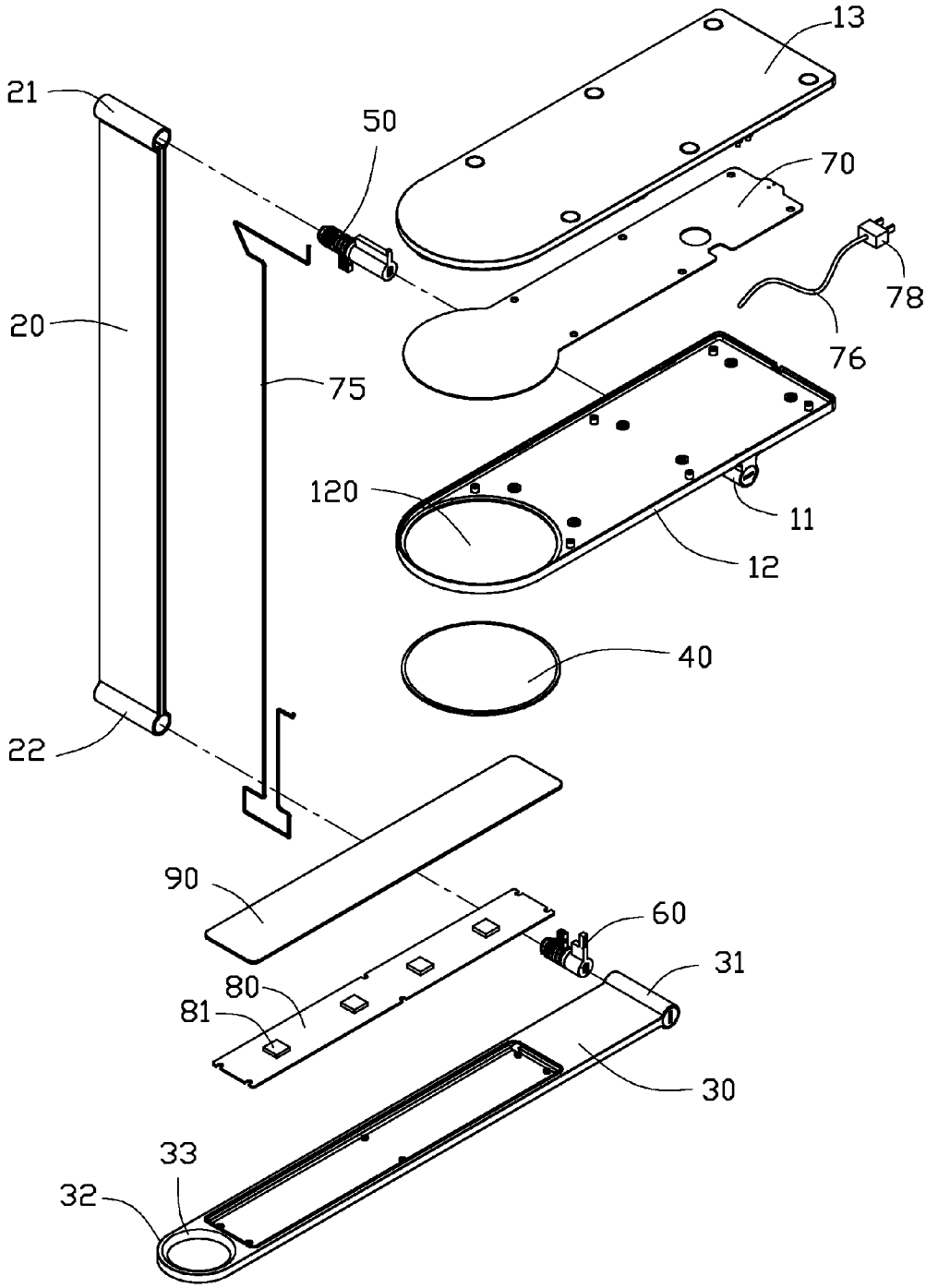
FIG. 3 is similar to FIG. 2, but viewed from another perspective.
Figure 4:
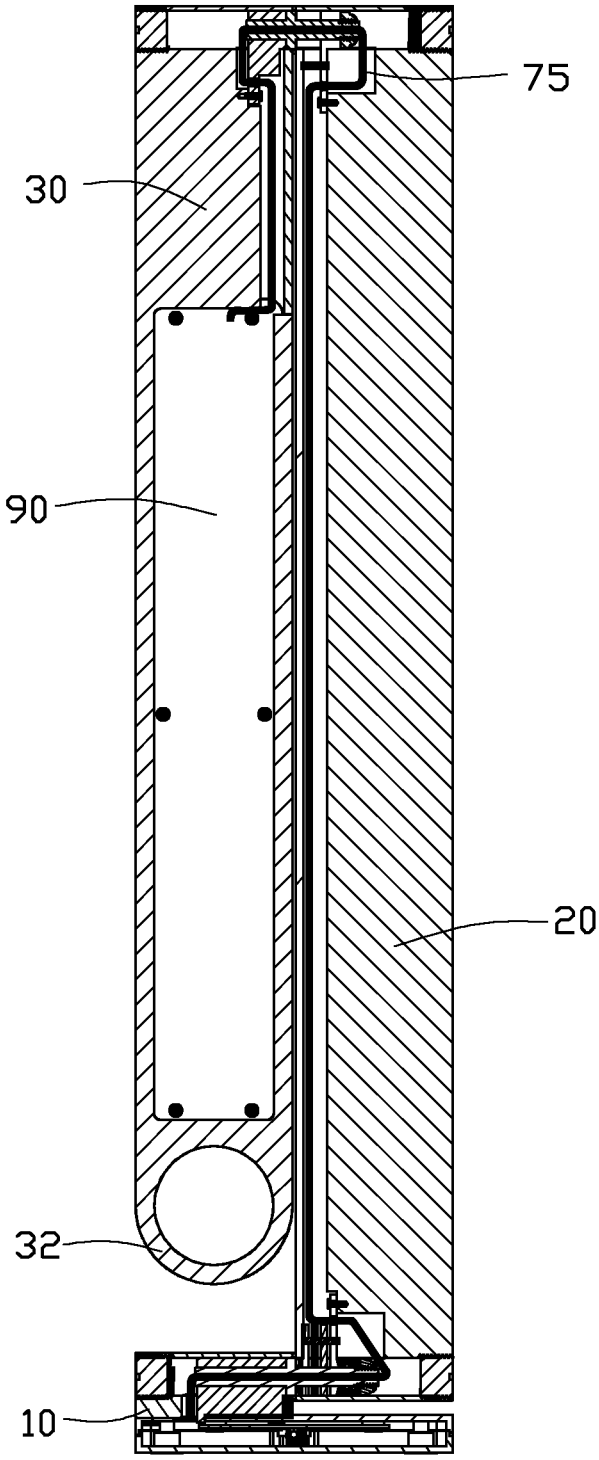
FIG. 4 is a cross-sectional view of the foldable LED table lamp of FIG. 1, taking along line IV-IV.

Referring to FIGS. 3-4, the table lamp 100 further includes to second PCB board 80 secured in the lamp body 30, a shield 90 mounted on the bottom surface of the lamp body 30, and a data cable 75. The data cable 75 connects the first and second PCB board 70 and 80 together for transmitting signals. An LED emitting element 81 is mounted on the second PCB board 80, and can emit light beams out through the shield 90. In the embodiment, the LED emitting element 81 is thin, flat and strip-shaped, and includes a number of LEDs. The shield 90 is affixed to the lamp body 30 via a double-faced adhesive tape (not shown).

The table lamp 100 further includes a luminous element 33 mounted on the handle 32. The luminous element 33 is electrically connected to the second PCB board 80, and can emit light under the control of the second PCB board 80. In the embodiment, the luminous element 33 provides warmer lights and serves as a night lamp. In an alternative embodiment, the luminous element 33 may be a self-emitting light source which emits lights without electricity power, such as a fluorescence lamp.

The table lamp 100 further includes a power cable 76 connected to the first PCB 70, and a plug 78 connected to the power cable 76.

Figure 5:
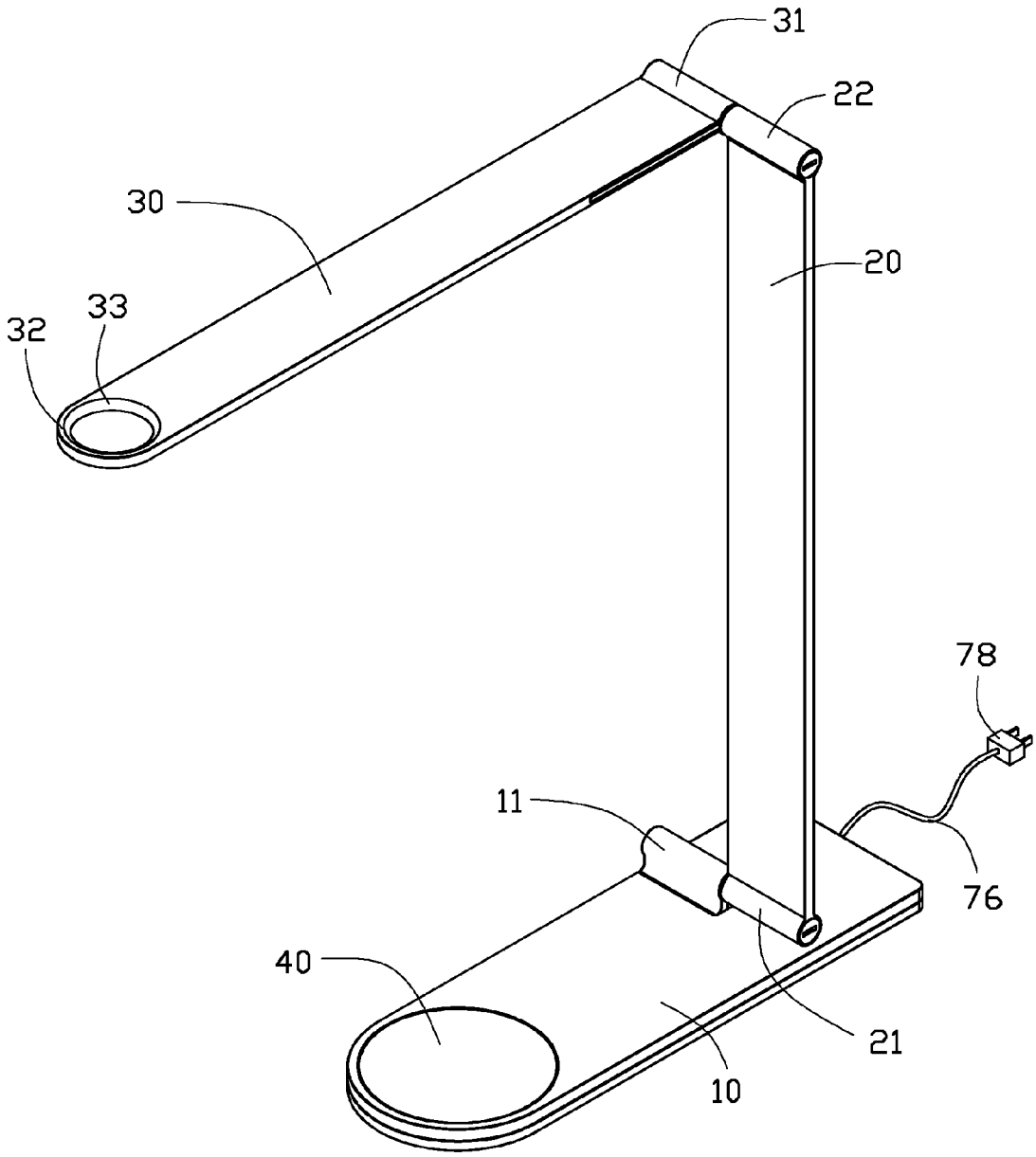
FIG. 5 is another isometric view of the foldable LED table lamp of FIG. 1, showing the foldable LED table lamp in a deployed state.

Referring to FIGS. 1, 2 and 5, in use, the plug 78 of the table lamp 100 can be plugged into a socket of a power supply (now shown). When the table lamp 100 is in the state as shown in FIG. 1, the user can grip the handle 32 to rotate the lamp body 30 about the second hinge 60 until the lamp body 30 is in the deployed state as shown in FIG. 5. Then, the user can touch the touch switch 40 to control the turn on/off the table lamp 100, or adjust the brightness or the color temperature of the table lamp 100. In this embodiment, the touch switch 40 generates operation signals in response to the touch operations of the user, and transmits the operation signals to the first PCB board. The first PCB board 70 transmits the operation signals to the second PCB board 80 via the data cable 75. The second PCB board 80 controls the LED emitting element 81 and the luminous element 33 to emit lights according to a specific operation signal.

Figure 6:
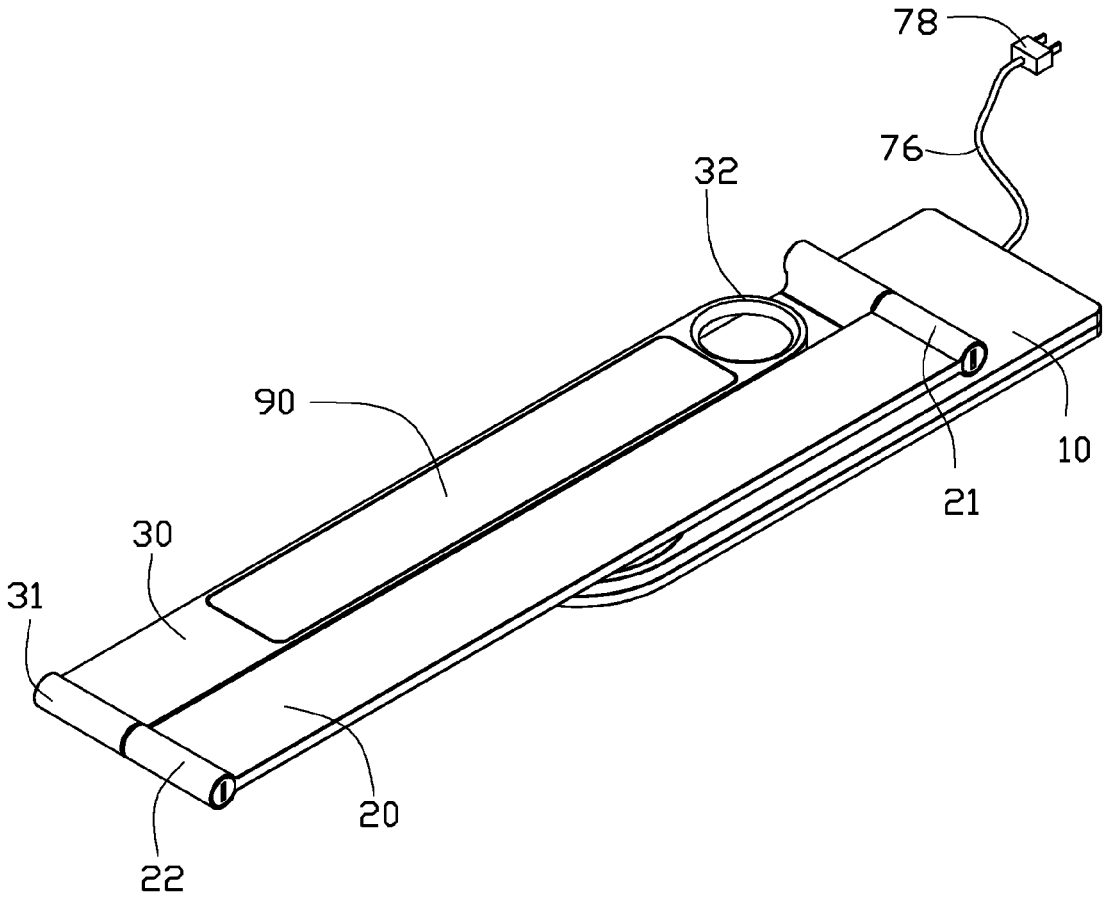
FIG. 6 is another isometric view of the foldable LED table lamp of FIG. 1, showing the foldable LED table lamp in a folded state.

When the table lamp 100 is in the deployed state, the user can grip the handle 32 to rotate the lamp body 30 along the second hinge 60 until the lamp body 30 returns to the state shown in FIG. 1. Then, the lamp body 30 and the holder 20 are rotated together along the first hinge 50 until the lamp body 30 and the holder 20 are in the folded state shown in FIG. 6. The table lamp 100 can be carried along after being turned off.

With such a configuration, compared with the conventional table lamps, the table lamp 100 has an advantage of ease carrying/storing.

Although the present disclosure has been specifically described on the basis of the embodiments thereof, the disclosure is not to be construed as being limited thereto. Various changes or modifications ma be made to the embodiments without departing from the scope and spirit of the disclosure.

What is claimed is:

1. A foldable LED table lamp comprising:

a base;

an elongated, holder having a first end hinged to the base and an opposing second end having an annular handle;

a self-emitting light source mounted on the annular handle;

an elongated lamp body having a first end hinged to the second end of the holder, the lamp body being rotatable between a first position where the lamp body is substantially perpendicular to the holder and a second position where the lamp body is juxtaposed with and parallel with the holder;

an LED emitting element fixed in the lamp body; and a touch sensitive switch mounted on the base and configured to control the LED emitting element.

2. The foldable LED table lamp of claim 1, wherein the base, the holder, and the lamp body are elongated plate-shaped.

3. The foldable LED table lamp of claim 2, wherein the touch sensitive switch is circular in shape.

4. The foldable LED table lamp of claim 2, wherein the holder is rotatable relative to the base about a first axis, and the lamp body is rotatable relative to the holder about a second axis, the second axis parallel to the first axis.

5. The foldable LED table lamp of claim 1, further comprising:

a first PCB board fixed in the base, and being electrically connected to the touch sensitive switch;

a second PCB board fixed in the lamp body, and being electrically connected to the LED emitting element; and an electrical cable electrically connecting the first PCB board to the second PCB board.

6. The foldable LED table lamp of claim 5, further comprising:

a power cable connected to the first PCB board; and a plug connected to the power cable.

7. The foldable LED table lamp of claim 1, wherein the base defines an opening, and the touch sensitive switch is fit within the opening.

8. The foldable LED table lamp of claim 7, wherein an upper surface of the touch sensitive switch is flush with an upper surface of the base.

9. The foldable LED table lamp of claim 1, wherein the touch sensitive switch is circular.

10. The foldable LED table lamp of claim 1, further comprising a shield mounted on a bottom surface of the lamp body.

11. The foldable LED table lamp of claim 1, wherein the luminous element is a fluorescence lamp.

* * * * *